US005556305A

United States Patent [19]

Naegelin

[11] Patent Number: 5,556,305

[45] Date of Patent: Sep. 17, 1996

[54] FUSE LOCKOUT MECHANISM

[75] Inventor: Conrad L. Naegelin, Redford, Mich.

[73] Assignee: Yazaki Corporation, Tokyo, Japan

[21] Appl. No.: 418,935

[22] Filed: Apr. 7, 1995

[51] Int. Cl.[6] ..... H01R 33/95

[52] U.S. Cl. ..... 439/622; 439/136

[58] Field of Search ..... 439/136, 138, 439/142, 148, 621, 622, 831, 681

[56] References Cited

U.S. PATENT DOCUMENTS

| | | | |
|---|---|---|---|
| 3,341,745 | 9/1967 | Munro . | |
| 3,833,875 | 9/1974 | Holoka . | |
| 4,000,447 | 12/1976 | Codruno . | |
| 4,221,455 | 9/1980 | Cairns et al. . | |
| 4,332,002 | 5/1982 | Yamaguchi et al. | 439/136 X |
| 4,550,964 | 11/1985 | Donais et al. | 439/142 |
| 4,687,270 | 8/1987 | Plyler et al. . | |
| 4,940,430 | 7/1990 | Fujitani et al. | 439/136 X |
| 4,941,851 | 7/1990 | Hsueh . | |
| 5,088,940 | 2/1992 | Salto . | |
| 5,171,293 | 12/1992 | Umemoto et al. . | |
| 5,179,503 | 1/1993 | Fouts et al. . | |
| 5,362,254 | 11/1994 | Siemon et al. | 439/142 X |
| 5,403,193 | 4/1995 | Ito et al. . | |
| 5,488,208 | 1/1996 | Seewald | 439/135 X |

*Primary Examiner*—Allan N. Shoap
*Assistant Examiner*—Christopher J. McDonald
*Attorney, Agent, or Firm*—Young & Basile

[57] ABSTRACT

An electric fuse junction box is provided with a fuse receptacle lockout cover which is movable between two positions to alternatively prevent insertion of a fuse into one or the other of two commonly wired fuse receptacles. The lockout cover thereby eliminates the possibility of fuses being present in both of the two fuse receptacles simultaneously.

10 Claims, 3 Drawing Sheets

FUSE LOCKOUT MECHANISM

FIELD OF THE INVENTION

The present invention relates to a fuse junction box having a plurality of fuse receptacles, two of which share a common electrical connection, and a manually selectable lockout mechanism which prevents the simultaneous insertion of fuses into both of the commonly connected fuse receptacles.

BACKGROUND OF THE INVENTION

Many automotive vehicles are equipped with a fuse junction box which serves to hold a plurality of fuses associated with the various electrically powered devices of the vehicle. One widely used type of automotive fuse takes the form of a pair of parallel blade-type contacts with the fusable portion constituting a bridge between the two blades. The fusable link is encased in a transparent insulative plastic and may be color coded according to the ampere rating of the fuse. A representative fuse junction box comprises a plurality of fuse receptacles containing spring clip contacts which engage the blades when the buses are pushed blade-end first into the receptacles. When properly inserted, each fuse forms part of an electrical circuit and protects the circuit from over-current conditions.

Some circuits supplying power to vehicle electrical devices are configured such that they may be energized only if the vehicle ignition switch has been moved to the ON/RUN or ACC (accessory) positions. Typically this switch movement energizes a relay to close a contact and supply power to the circuit from the vehicle battery or generator. This ignition switch controlled circuit commonly known as the accessory circuit typically powers devices such as the radio power windows and electric window defroster. Since the ignition key is required to move the ignition switch to the ON/RUN or ACC positions devices powered by the accessory circuit cannot be left on inadvertently when the vehicle is parked and the ignition key is removed thus lessening the likelihood of the vehicle battery losing its charge.

Many other vehicle electrical devices are powered by circuits wired so that they may be supplied with power regardless of the ignition switch position. Devices such as the clock emergency flashers headlights and interior lights are included in what is known as the battery circuit being wired directly to the vehicle battery without passing through the ignition switch actuated relay.

It is known in the automotive industry to provide a fuse box wired to permit a particular electrical device to be switched between the two power supply configurations described above simply by moving the fuse protecting that device from first fuse receptacle to a second fuse receptacle. To achieve this one of the two fuse receptacles is wired to connect the electrical device to the accessory circuit and the other receptacle is wired to connect the device to the battery circuit. In effect the fuse for the device serves as a switch and the selection between the two power supply configurations may be made at the vehicle production plant, at the vehicle retail dealer, or by the vehicle owner/operator.

A drawback to this switchable circuit arrangement is that it is possible for a person unaware of the nature and function of the fuse switchable circuit described above to insert fuses into both of the commonly wired fuse receptacles simultaneously. This results in a short circuit condition which may cause any number of electrical devices to malfunction and/or may allow the vehicle battery to be drained of its charge.

SUMMARY OF THE INVENTION

The present invention is generally directed toward an automotive fuse junction box designed such that it is physically impossible for an automotive type fuse to be present simultaneously in each of two commonly wired fuse receptacle locations while readily permitting, with only a simple manual manipulation, a fuse to be selectively inserted into one or the other of the receptacles in normal fashion.

In general, this is accomplished by providing, in combination with a fuse junction box of generally conventional design, a blocking device which is alternatively and selectively displaceable between a first position wherein it blocks the insertion of a fuse into one of two commonly wired fuse receptacles while permitting unobstructed access to the other, and a second position wherein it blocks the insertion of a fuse into the second of the two commonly wired receptacles while leaving the first receptacle unobstructed.

In a first illustrative embodiment, the blocking device takes the form of a fuse lockout cover slidable between the first and the second position along rails formed on the fuse junction box.

In a second embodiment, the blocking device takes the form of a pivotally mounted lockout cover that is rotated in a first direction to assume the first position and in an opposite direction to assume the second position.

These and other features of the present invention will be further explained and developed in the detailed description of the preferred embodiment to follow.

DETAILED DESCRIPTION OF THE INVENTION

Figure 3:
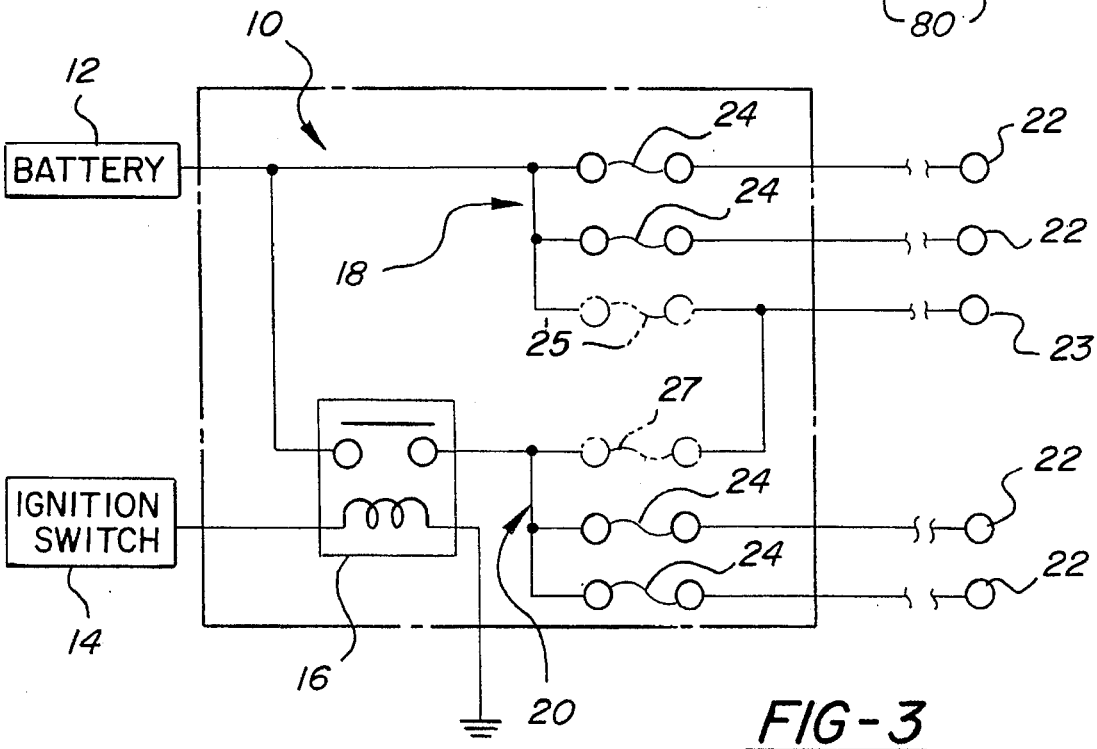
FIG. 3 is a schematic depiction of part of a typical automobile electrical circuit of the type toward which the present invention is directed.

FIG. 3 illustrates in schematic form a portion of an automotive vehicle electrical circuit 10 comprising a battery 12, an ignition switch 14, a relay 16, a battery circuit 18, and an accessory circuit 20. A plurality of electrical devices 22 are protected by fuses 24 and are connected to either battery circuit 18 or accessory circuit 20. Battery circuit 18 is wired directly to battery 12 so that devices connected to battery circuit 18 are supplied with electrical power and may be operated regardless of the condition of ignition switch 14. Examples of devices for which this direct battery connection is desirable include but are not limited to a clock, emergency flashers, headlights and interior lights.

Accessory circuit 20 is connected to battery 12 through relay 16 so that it is only energized when relay 16 is activated by moving ignition switch 14 out of an OFF position to ACC or ON/RUN positions. Thusly, electrical devices connected to accessory circuit 20 may not be operated unless the key-actuated ignition switch 16 is turned. Examples of automotive devices typically powered by such an accessory circuit are a radio, power windows, and an electric window defroster.

A fuse-switchable device 23 is wired so that it may be supplied with power from either battery circuit 18 or accessory circuit 20, the selection between the two being made by inserting a fuse at either position 25 or 27 respectively. Note that if fuses are inserted simultaneously at both positions 25 and 27 a short-circuit condition results wherein electrical devices 22 connected to accessory circuit 20 are powered by battery 12 regardless of the condition of relay 16, thereby defeating the purpose of dividing the vehicle electrical system into separate battery and accessory circuits.

Figure 1:
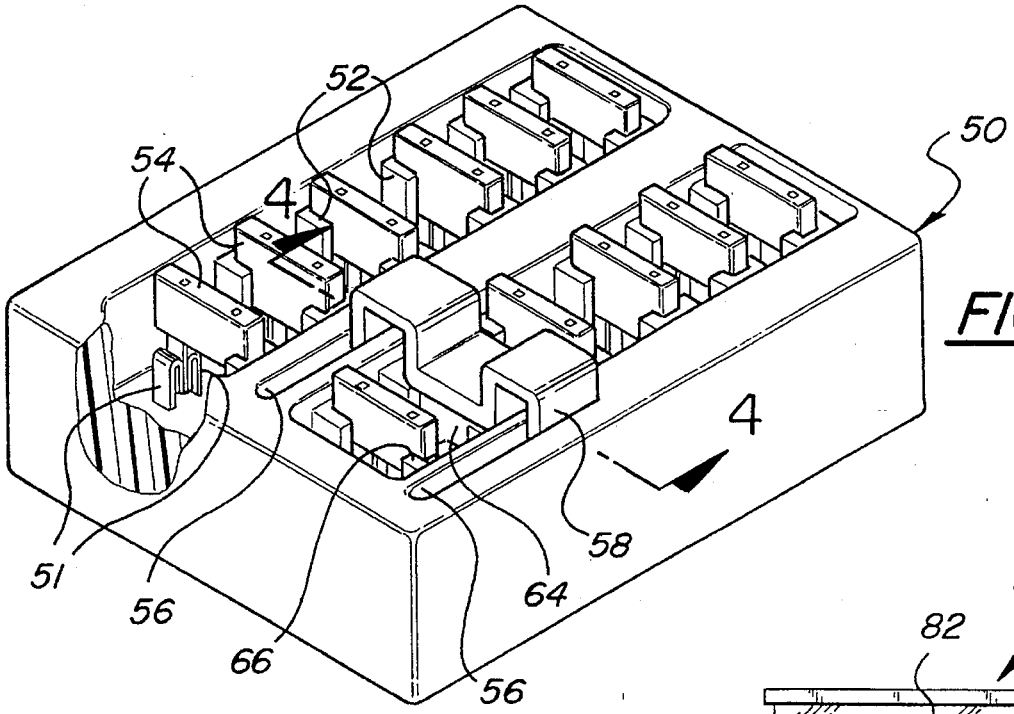
FIG. 1 is a perspective view of a fuse junction box in accordance with a first embodiment of the present invention.

Referring now to FIG. 1, a fuse junction box 50 is depicted having features which effectively prevent the insertion of fuses simultaneously at positions 25 and 27 as described above. Fuse junction box 50 is of generally conventional construction, being made of an electrically non-conductive material such as thermoplastic and containing electrical wiring and contacts which form part of the circuitry associated with the various electrical systems and devices of an automotive vehicle. The upper surface of fuse junction box 50 has formed therein two rows of fuse receptacles 52, each receptacle 52 having a pair of spring clip electrical contacts 51 located at its bottom.

Figure 2:
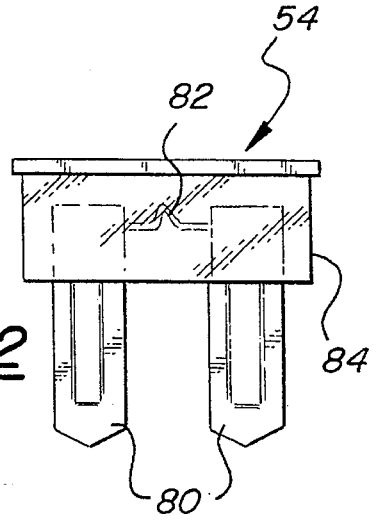
FIG. 2 is a perspective view of an automotive-type fuse usable in the fuse junction box of the present invention.

FIG. 2 depicts a fuse 54 which is representative of those commonly used in automotive vehicle circuit applications. Fuse 54 comprises a pair of parallel blade-type contacts 80 which are connected at their upper ends by a fusable link 82. A cap 84 covers the upper ends of blades 80 and fusable link 82 and is formed of a electrically insulative material, commonly some form of plastic. A fuse 54 is inserted into each of the fuse receptacles 52 such that blades 80 are engaged by and make electrical contact with spring clip contacts 51, thereby providing over-current protection for the electrical circuit wired to the fuse receptacle 52.

Figure 4:
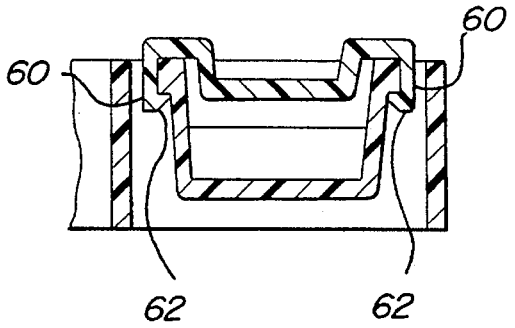
FIG. 4 is a sectional view taken along line 4—4 in FIG. 1.

Two slide tracks 56 are formed as recesses in the upper surface of fuse junction box 50, running along opposite sides of and parallel with the row of fuse receptacles 52. A lockout cover 58 engages slide tracks 56, as best shown in FIG. 4, by means of end tabs 60 which extend down from either end of lockout cover 58 into the respective slide track 56. A hook 62 is formed at the end of each end tab 60, and hooks 62 engage slide track 56 in a manner to retain lockout cover 58 in slide tracks 56 and allow it to slide therein.

Tracks 56 are of such a length that lockout cover 58 may slide to positions above either of two adjacent fuse receptacles 64 and 66. Battery fuse receptacle 64 and accessory fuse receptacle 66 are both wired to the fuse-switchable device 23 of FIG. 3 and correspond to fuses 25 and 27 respectively. When lockout cover 58 is in the position shown in FIG. 1, it covers and effectively blocks battery fuse receptacle 64 so that a fuse cannot be present therein, while leaving accessory fuse receptacle 66 unobstructed so that a fuse may be present, thereby configuring the circuit such that ignition switch 14 must be actuated to energize relay 16 in order for fuse-switchable device 23 to function. Note that when a fuse 54 is in place in accessory fuse receptacle 66, fuse cap 84 extends high enough to physically obstruct movement of lockout cover 58 away from its position blocking battery fuse receptacle 64, thus ensuring that fuses can never be present in both receptacles simultaneously.

Figure 5:
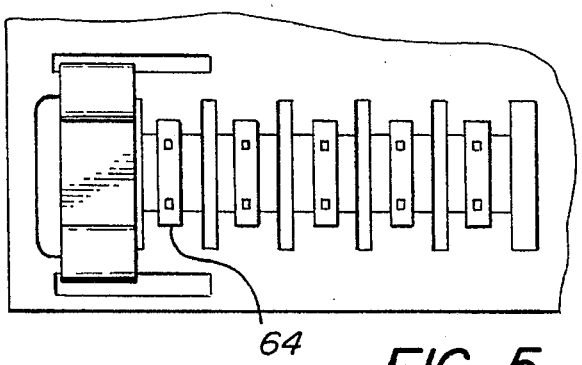
FIG. 5 is a partial top view of the fuse junction box of FIG. 1, with the lockout cover moved to a second position.
Figure 6:
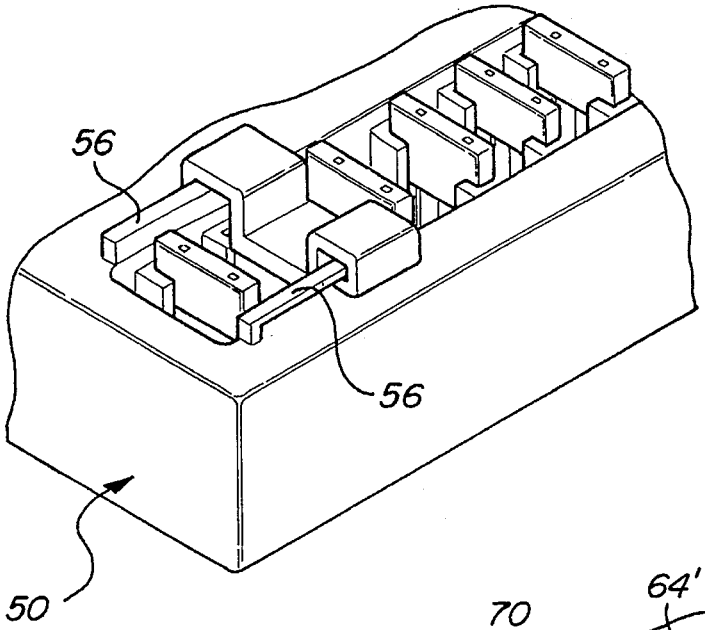
FIG. 6 is a partial perspective view of the fuse junction box of the first embodiment of the invention, with the slide rails formed in an alternative manner.
Figure 7:
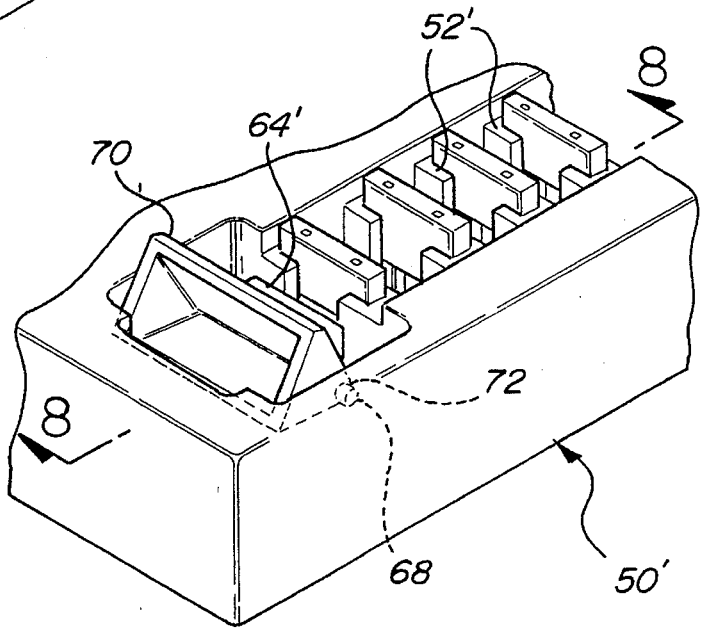
FIG. 7 is a partial perspective view of a fuse junction box in accordance with a second embodiment of the present invention, with the fuse lockout cover shown in a first position.
Figure 8:
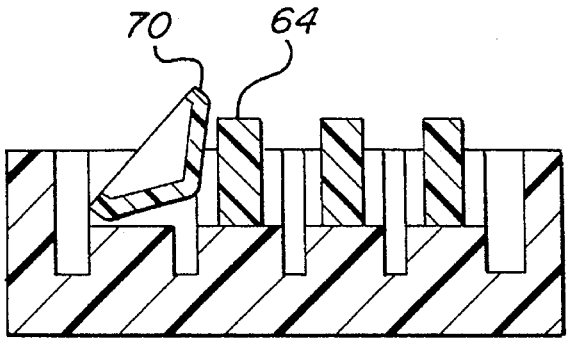
FIG. 8 is a sectional view taken along line 8—8 of FIG. 7.

If it is desired to reconfigure the circuit so that fuse switchable device 23 bypasses relay 16 and is powered directly from battery 12, the fuse is removed from accessory fuse receptacle 66 and lockout cover 58 is moved to the position shown in FIG. 5 wherein it covers and effectively prevents access to accessory fuse receptacle 66. The fuse is then inserted in battery fuse receptacle 64, thereby producing a circuit configuration wherein fuse switchable device 23 is connected directly with battery 12.

Note that when a fuse 54 is present in battery fuse receptacle 64, physical interference between the fuse cap 84 and lockout cover 58 makes it impossible to move lockout cover 58 away from its position blocking accessory fuse receptacle 66, thus ensuring that fuses can never be present in both receptacles simultaneously.

Slide rails 56 may be formed in a number of different ways without departing from the scope of the present invention, and FIG. 5 illustrates an alternative configuration wherein they project above the surface of the block 50.

In an alternative embodiment of the present invention, depicted in FIGS. 7 through 11, fuse junction box 50' has a plurality of fuse receptacles 52' including a battery circuit fuse receptacle 64' and an adjacent accessory circuit fuse receptacle 66', both of which are wired to fuse switchable device 23. A pair of pivot holes 68 are located between fuse receptacles 64' and 66'. A rocker-type fuse receptacle lockout cover 70 has a pivot pin 72 projecting from each end thereof, with pivot pins 72 retained in pivot holes 68 so that lockout cover 70 may be rotated between the alternative blocking positions shown in FIGS. 8 and 9.

Figure 9:
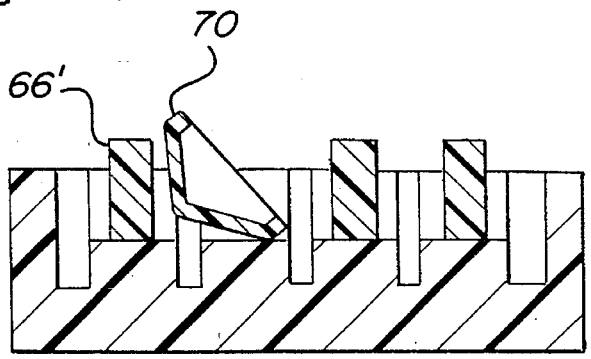
FIG. 9 is a sectional view similar to FIG. 8, but with the lockout cover moved to a second position.
Figure 10:
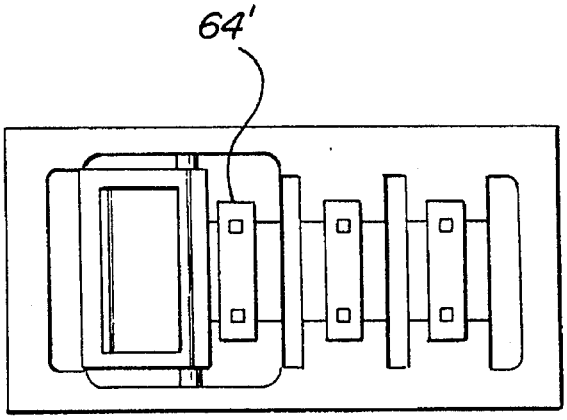
FIG. 10 is a partial top view of the fuse junction box of FIG. 7 with the fuse lockout cover in the first position.
Figure 11:
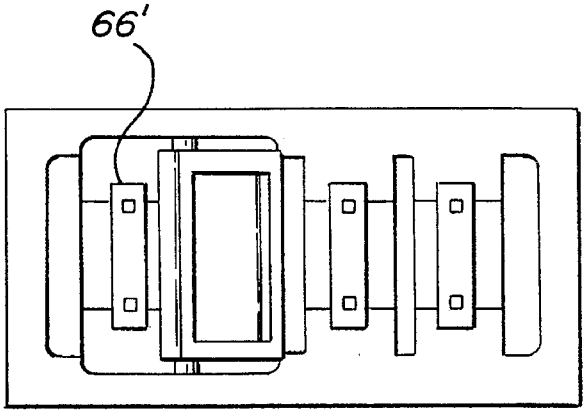
FIG. 11 is a partial top view of the fuse junction box of FIG. 7 with the lockout cover moved to the second position.

When lockout cover 70 is rotated fully clockwise as seen in FIGS. 9 and 11, it permits insertion of a fuse into accessory circuit fuse receptacle 66' while effectively preventing insertion of a fuse into battery circuit fuse receptacle 64'. If it is desired to reconfigure the circuit so that fuse switchable device 23 receives power directly from battery 14, the fuse is removed from accessory circuit fuse receptacle 66', lockout cover 70 is rotated counter-clockwise to the position shown in FIGS. 7, 8 and 10 and the fuse is inserted into battery circuit fuse receptacle 64'. Note that when a fuse is present in either of fuse receptacles 64' or 66', physical interference between the fuse and lockout cover 70 makes it impossible to move lockout cover 70 away from its blocking position, thus ensuring that fuses can never be present in both receptacles simultaneously.

Both embodiments of the present invention described above provide a positive means for preventing the insertion of fuses into both the accessory and the battery circuit fuse receptacles simultaneously and so prevent the inadvertent occurrence of an undesirable short circuit condition in the vehicle electrical system. Many modifications and variations of the present invention are possible in light of the above teachings, and the described embodiments are not intended to limit the scope of the present invention in any way.

I claim:

1. A fuse junction box comprising:

a plurality of fuse receptacles formed in the fuse junction box and adapted to operatively receive electric fuses, the plurality of fuse receptacles including a first fuse receptacle and a second fuse receptacle, the first fuse receptacle connecting an electrical device to a first power supply circuit when a fuse is present therein and the second fuse receptacle alternatively connecting the electrical device to a second power supply circuit when the fuse is present therein; and blocking means moveable between a first position permitting the fuse to be present in the second fuse receptacle while physically obstructing the first fuse receptacle so that no fuse can be present therein, and a second position permitting the fuse to be present in the first fuse receptacle while physically obstructing the second fuse receptacle so that no fuse can be present therein;

wherein the fuse when present in the first fuse receptacle physically interferes with the blocking means to inhibit movement of the blocking means away from the second position, and the fuse when present in the second fuse receptacle physically interferes with the blocking means to inhibit movement of the blocking means away from the first position.

2. The fuse junction box of claim 1, wherein the blocking means comprises sliding means moveable in a substantially linear manner between the first position and the second position.

3. The fuse junction box of claim 2, wherein the sliding means is in sliding engagement with a track formed integrally with the fuse junction box.

4. The fuse junction box of claim 1, wherein the blocking means comprises rocking means rotatably attached to the fuse junction box to be pivotable between the first position and the second position.

5. The fuse junction box of claim 4, wherein the rocking means rotatably engages at least one hole formed integrally with the fuse junction box.

6. A fuse junction box for operatively connecting a plurality of electric fuses with a plurality of electrical circuits, the fuse junction box comprising at least a first fuse receptacle and a second fuse receptacle, the improvement comprising blocking means movable between a first position and a second position, wherein:

the blocking means when in the first position permits a fuse to be present in the second fuse receptacle while physically obstructing the first fuse receptacle so that no fuse can be present therein, movement of the blocking means away from the first position being inhibited by physical interference with the fuse when it is present in the second fuse receptacle; and the blocking means when in the second position permits the fuse to be present in the first fuse receptacle while physically obstructing the second fuse receptacle so that no fuse can be present therein, movement of the blocking means away from the second position being inhibited by physical interference with the fuse when it is present in the first fuse receptacle.

7. The fuse junction box of claim 6 wherein the blocking means comprises:

a track provided on the fuse junction box; and sliding means engaging the track means to be moveable therealong in a substantially linear manner between the first position and the second position.

8. The fuse junction box of claim 6 wherein the blocking means comprises:

a hole provided on the fuse junction box to define an axis of rotation; and rocking means engaging the hole means and pivotable about the axis between the first position and the second position.

9. A fuse junction box for holding a plurality of electric fuses in operative connection with a plurality of circuits, the fuse junction box comprising at least a first fuse receptacle and a second fuse receptacle, the improvement comprising:

a lockout cover engaging a pair of parallel slide tracks formed integrally with the fuse junction box, the lockout cover movable along the slide tracks between a first position physically obstructing the first fuse receptacle so that no fuse can be inserted therein and leaving the second fuse receptacle unobstructed, and a second position physically obstructing the second fuse receptacle so that no fuse can be inserted therein and leaving the first fuse receptacle unobstructed;

wherein presence of a fuse in the first fuse receptacle physically interferes with movement of the lockout cover away from the second position, and presence of the fuse in the second fuse receptacle physically interferes with movement of the lockout cover away from the first position.

10. A fuse junction box for holding a plurality of electric fuses in operative connection with a plurality of circuits, the fuse junction box comprising at least a first fuse receptacle and a second fuse receptacle, the improvement comprising:

a lockout cover engaging a pair of pivot holes formed in the fuse junction box, the lockout cover rotatable about the pivot holes between a first position physically obstructing the first fuse receptacle so that no fuse can be inserted therein and leaving the second fuse receptacle unobstructed, and a second position physically obstructing the second fuse receptacle so that no fuse can be inserted therein and leaving the first fuse receptacle unobstructed;

wherein presence of a fuse in the first fuse receptacle physically interferes with movement of the lockout cover away from the second position, and presence of the fuse in the second fuse receptacle physically interferes with movement of the lockout cover away from the first position.

* * * * *